United States Patent [19]

Anderson et al.

[11] Patent Number: 4,974,990

[45] Date of Patent: Dec. 4, 1990

[54] RAISED PAVEMENT MARKER APPLICATOR

[75] Inventors: Conrad V. Anderson, Minneapolis; Patricia L. Gehring, Woodbury; Bradley J. Heath; Russell D. Quam, both of Cottage Grove, all of Minn.; Demetrios V. Halatsis, Brussels, Belgium

[73] Assignee: Minnesota Mining and Manufacturing Company, Saint Paul, Minn.

[21] Appl. No.: 426,735

[22] Filed: Oct. 24, 1989

[51] Int. Cl.[5] ..... E01C 23/16

[52] U.S. Cl. ..... 404/94; 221/185; 221/289

[58] Field of Search ..... 404/94; 221/185, 289, 221/297, 299; 156/574, 575, 578

[56] References Cited

U.S. PATENT DOCUMENTS

| | | | |
|---|---|---|---|
| 3,179,289 | 4/1965 | Moyer et al. | 221/289 X |
| 3,358,881 | 12/1967 | Medina | 221/289 X |
| 3,540,358 | 11/1970 | Oakley | 94/39 |
| 3,590,701 | 7/1971 | Ten Broeck | 404/94 X |
| 3,841,293 | 10/1974 | Laporte et al. | 221/289 X |
| 3,864,052 | 2/1975 | Blomberg | 404/94 |
| 4,623,280 | 11/1986 | Stenemann | 404/93 |

*Primary Examiner*—William P. Neuder

*Attorney, Agent, or Firm*—Donald M. Sell; Walter N. Kirn; Douglas B. Little

[57] ABSTRACT

An apparatus for oriented application of a raised pavement marker to a roadway surface includes a reservoir of liquid adhesive; means for discharging a portion of liquid adhesive to form a deposit on the roadway, means for dispensing a raised pavement marker onto the top of the adhesive deposit; and means for aligning the marker at a desired orientation. The apparatus may also include a magazine for storing and sequentially delivering a plurality of raised pavement markers to the means for dispensing. The magazine has inclined walls which accommodate markers with rounded tops and prevent twisting or jamming of the markers.

17 Claims, 7 Drawing Sheets

RAISED PAVEMENT MARKER APPLICATOR

BACKGROUND OF THE INVENTION

1. Field of the Invention.

The invention concerns an applicator which mechanically applies raised pavement markers and, in particular, an apparatus for oriented application of raised pavement markers 2. Description of the Related Art.

Raised pavement markers provide better nighttime and wet delineation of traffic lanes than do painted lines and tapes. Typical raised pavement markers include a retro-reflective surface for orientation toward oncoming vehicular traffic The retro-reflective surface is carried on a marker body, which is adhesively bonded to a roadway surface.

Raised pavement markers are typically bonded to roadway surfaces using one of two alternative adhesives, a two-part epoxy and hot-melt bitumen. A thermal adhesive applicator, Model PD-1001, sold by Pinkley Sales Company of Oklahoma City, Okla., has a roller frame, a heated bitumen reservoir and a dispensing valve. The unit also includes a brake assembly for the wheels. A hand control opens the drip-free dispensing valve to deposit hot-melt bitumen upon a roadway surface.

Considerable development of both retro-reflective material and marker bodies has occurred in recent years One well-known raised pavement marker, a Stimsonite 88 marketed by Amerace Corp. has a truncated pyramid shape. The Stimsonite 88 raised pavement markers may be stacked one upon another. A marker dispenser Model 101 from Downing Manufacturing Company, Tulsa, Okla., is a side-mounted accessory for the bitumen applicator. The dispenser has a four-inch by four-inch vertically mounted tube and a release cam mechanism for dispensing one marker at a time. The Downing dispenser may be effectively used with Stimsonite 88 style markers.

Another particularly desirable raised pavement marker marketed by Minnesota Mining and Manufacturing Company of St. Paul, Minn. (3M), has a rounded upper surface and is described in U.S. Pat. No. 4,875,798 incorporated herein by reference. The 3M raised pavement markers, however, resist attempted stacking because of their rounded upper surface Unfortunately, due to the rounded upper surface of a 3M style raised pavement marker (and the inability to stack 3M raised pavement markers), 3M raised pavement markers cannot be suitably dispensed by a Downing style marker dispenser.

Currently, 3M style raised pavement markers are applied by placing each marker by hand in a roadway deposit of liquid adhesive. Such an application method is slow.

An additional consideration in installing pavement markers is appropriate alignment of the raised pavement markers such that the retro-reflective surface is appropriately illuminated and effectively visible to vehicular traffic. Once the adhesive has "set" readjustment is nearly impossible. A misoriented marker generally must be removed and replaced.

The present invention allows efficient installation of raised pavement markers, such as the 3M style markers referenced above, while eliminating the need to place each marker by hand. Additionally, the present invention provides an improved placement and orientation of a 3M style raised pavement marker on a highway. The present invention has the potential to reduce the cost of installing raised pavement markers.

SUMMARY OF THE INVENTION

The present invention includes an apparatus for oriented application of a raised pavement marker (RPM) to a roadway surface. The apparatus comprises a reservoir of liquid adhesive; means for discharging a portion of liquid adhesive to form a deposit of liquid adhesive on the roadway surface; means for dispensing a raised pavement marker on top of the deposit of liquid adhesive; and means for aligning the transferred raised pavement marker in the liquid adhesive at a desired orientation with respect to the apparatus.

The invention is particularly useful for applying raised pavement markers having a rounded top. Such markers are generally resistant to stacking. The invention, therefore, may further comprise a magazine for storing and sequentially delivering a plurality of markers to the means for dispensing.

The present invention also includes a dispenser for raised pavement markers comprising a support deck, having an upper surface adapted for receiving a raised pavement marker, and a push bar adapted for sweeping the upper surface of the support deck. Guide means slidably connect the push bar to the support deck and allow reciprocal movement of the push bar relative to the support deck. The reciprocal movement consists of a sweeping stroke and a return stroke. Means, slidably mounted to the support deck, hold a raised pavement marker against the push bar during a sweeping stroke and release the raised pavement marker on a return stroke. The dispenser may also include a magazine adapted for storage and delivery of a plurality of raised pavement markers to the upper surface of the support deck.

DETAILED DESCRIPTION OF THE PREFERRED EMBODIMENTS

The preferred embodiment of the apparatus includes a reservoir and discharge for liquid adhesive; a raised pavement marker dispenser; a magazine and an alignment assembly. These components are described below.

Figures 1, 2:
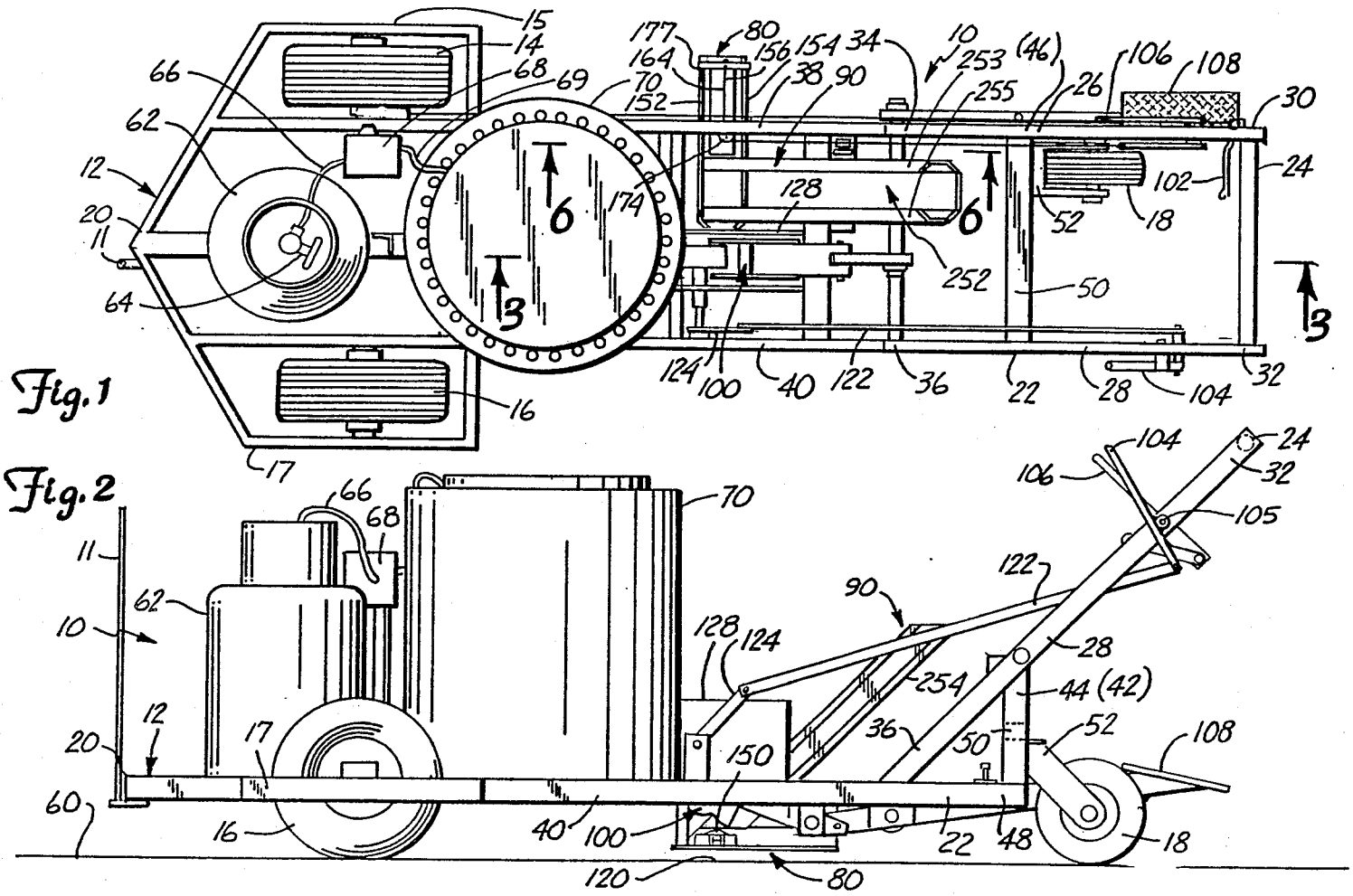
FIG. 1 is a top view of the apparatus of the present invention.
FIG. 2 is a side view of the present invention.

The applicator apparatus 10 as shown in FIG. 1 has a frame 12 carried on three wheels, a front right wheel 14 in a wheel frame extension 15, a front left wheel 16 in a wheel frame extension 17, and a castered rear wheel 18. The frame 12 has a front or leading portion 20 and a rear or following section 22. A handle 24 is held at a comfortable height for pushing the apparatus 10 by right and left inclined frame member 26 and 28 at upper rearward ends 30 and 32, respectively. Inclined frame members of 26 and 28 are welded at their lower forward ends 34 and 36 to right rail 38 and left rail 40 of frame 12. Right vertical brace 42 (shown in FIG. 3) and left vertical brace 44 (shown in FIG. 2) extend upwardly from the rear of right rail 38 and the rear 48 of left rail 40. A cross bar 50 extends between the vertical supports 42 and 44 and serves to stiffen the frame 12. Rear wheel 18 is carried by a caster assembly 52 attached below cross bar 50, adjacent the right side of cross bar 50 to allow pivoting, about a vertical axis slightly forward of rear wheel 18. The rear wheel 18 is offset from the center, such that any raised pavement marker and its associated typical adhesive deposit are avoided by the rear wheel 18 when the apparatus 10 is pushed forward to a subsequent application position. The castered wheel assembly 52 and rear wheel 18 enables steering of the apparatus 10 by applying lateral force to the handle 24. Thus, the apparatus 10 may be positioned on a roadway 60. In addition to being positioned upon a roadway 60, the apparatus 10 may be oriented such that the front 20 of the frame 12 and the rear 22 of the frame 12 may be aligned by means of pointer 11 on a roadway 60 parallel to pathways typically followed by vehicular traffic. Pointer 11 is attached to the frame by a means known in the art.

ADHESIVE RESERVOIR AND DISCHARGE

The frame 12 carries, from front 20 to rear 22*a* fuel tank 62 containing propane or butane, a valve 64, a supply tube 66, a control 68, and a tube 69 leading to a hot-melt bitumen reservoir 70. The reservoir 70 is thermostatically controlled to maintain bitumen at a desirable temperature. Rearward of the reservoir 70 is a marker dispenser assembly 80. An inclined magazine 90 extends upwardly and rearwardly from the dispenser assembly 80. Adjacent and left (i.e. operator's left) of the dispenser assembly 80 is an alignment assembly 100. Controls for the various assemblies are located so as to be accessible to an operator standing at handle 24. Specifically included controls are brake handle 102, adhesive handle 104, dispenser handle 106, and alignment pedal 108.

With the apparatus positioned and aligned parallel to traffic flow, a brake (not shown) on right front wheel 14 is applied by releasing pressure to brake control handle 102. This serves to arrest the position and aligned orientation of the apparatus 10 over a location 120 selected on roadway 60. At position 120 of roadway 60, an operator may first actuate reservoir valve handle 104. Handle 104 is pivotably connected to the left inclined frame member 28 at pivot point 105 and connected to control rod 122 which, in turn, is connected to and actuates valve handle 124 releasing a deposit of hot-melt bitumen from reservoir 70 The deposit of hot-melt bitumen initially is liquid and spreads over the roadway surface about position 120 prior to "setting" (i.e. solidifying or hardening).

Alternatively, a two-part epoxy adhesive could be applied at position 120. Two-part epoxies are widely used for marker adhesive and well-known in the art, as are various devices for mixing of two-part epoxies at the time of discharge onto the roadway surface 60. However, hot-melt adhesive is believed to be generally preferable to epoxy adhesive since hot-melt bitumen is less costly than epoxy and particularly effective as an adhesive on fresh asphalt. Hot-melt bitumen is somewhat less effective on concrete in which situation a two part epoxy, which is more widely used in the industry, may be appropriate. Details of the reservoir valve are shown in the partial sectional view of FIG. 3, where valve cap 126 is shown. Cap 126 may be opened to allow a flow or discharge of adhesive to position 120 on the roadway surface 60 by movement of valve handle 124. Wind screen 128 surrounds and is spaced apart from valve 126 and serves to protect the discharged portion of liquid adhesive from deflection by wind currents.

The wind screen 128 should be shaped to allow the operator to see dispensing of the pavement markers 150 and 151. This can be accomplished by configuring it with a rearward side lower than the right and left sides to allow looking down into the dispensing area. Alternatively it could be made of a transparent material.

DISPENSING ASSEMBLY

Figure 3:
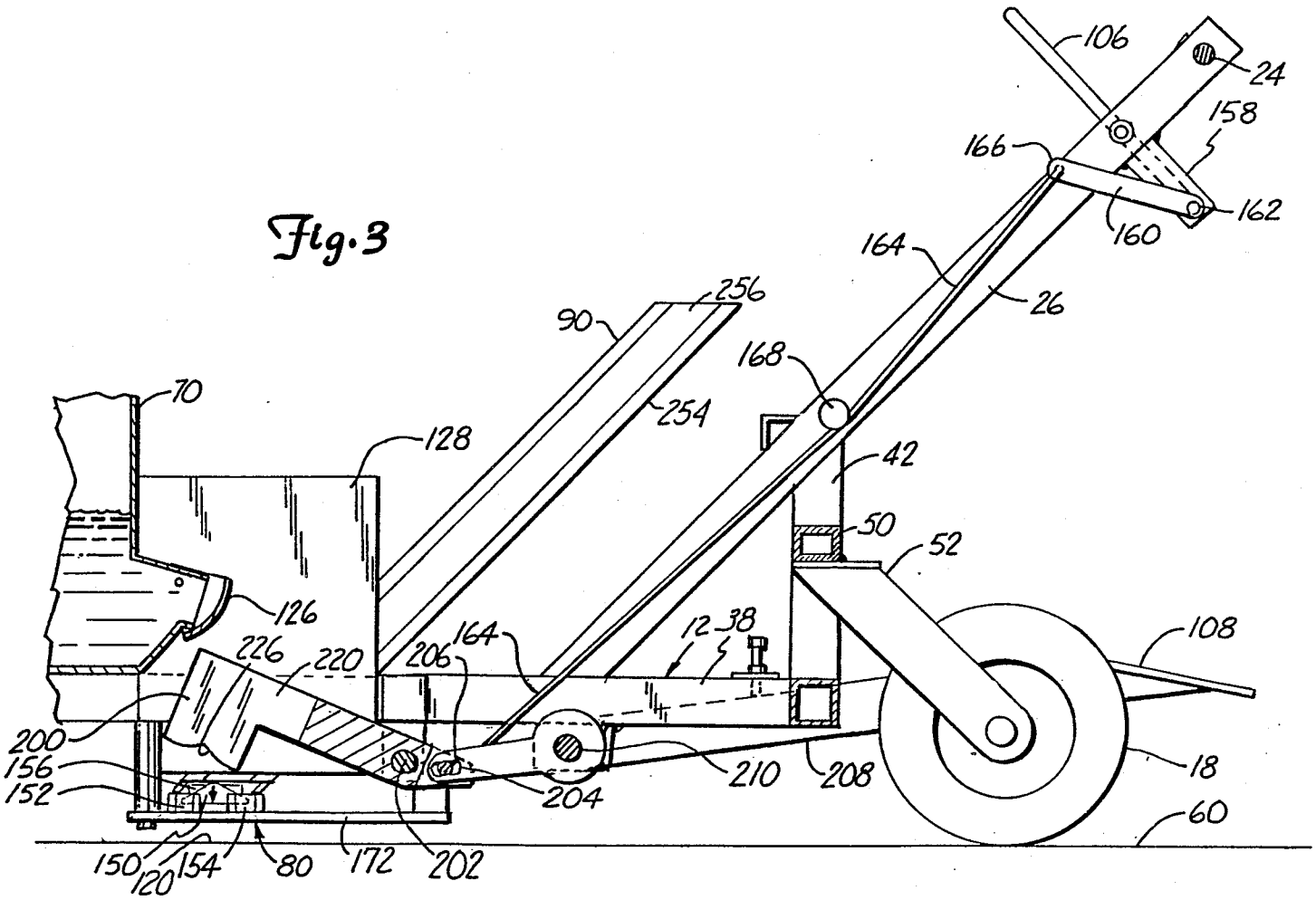
FIG. 3 is a sectional side view of the present invention at lines 3—3 of FIG. 1.

Dispensing assembly 80, as shown in FIG. 3, serves to dispense a raised pavement marker 150 onto the top of the deposit of liquid adhesive at position 120 of roadway surface 60. Dispensing assembly 80 includes forward slide bar 152, rearward slide bar 154 and push bar 156. The dispensing assembly is actuated by a rearward pull on dispensing handle 106 which is pivotably connected through bracket 158 rigidly to offset arm 160 at pivoting connection 162. A flexible control cable 164 is attached at opposite end 166 on the inside or left-hand side of right inclined frame member 26. The cable 164 is led along the left side of inclined frame member 26 by pulley 168 and then, as illustrated in FIG. 4, forward by pulley 170 attached to base plate 172.

Figure 4:
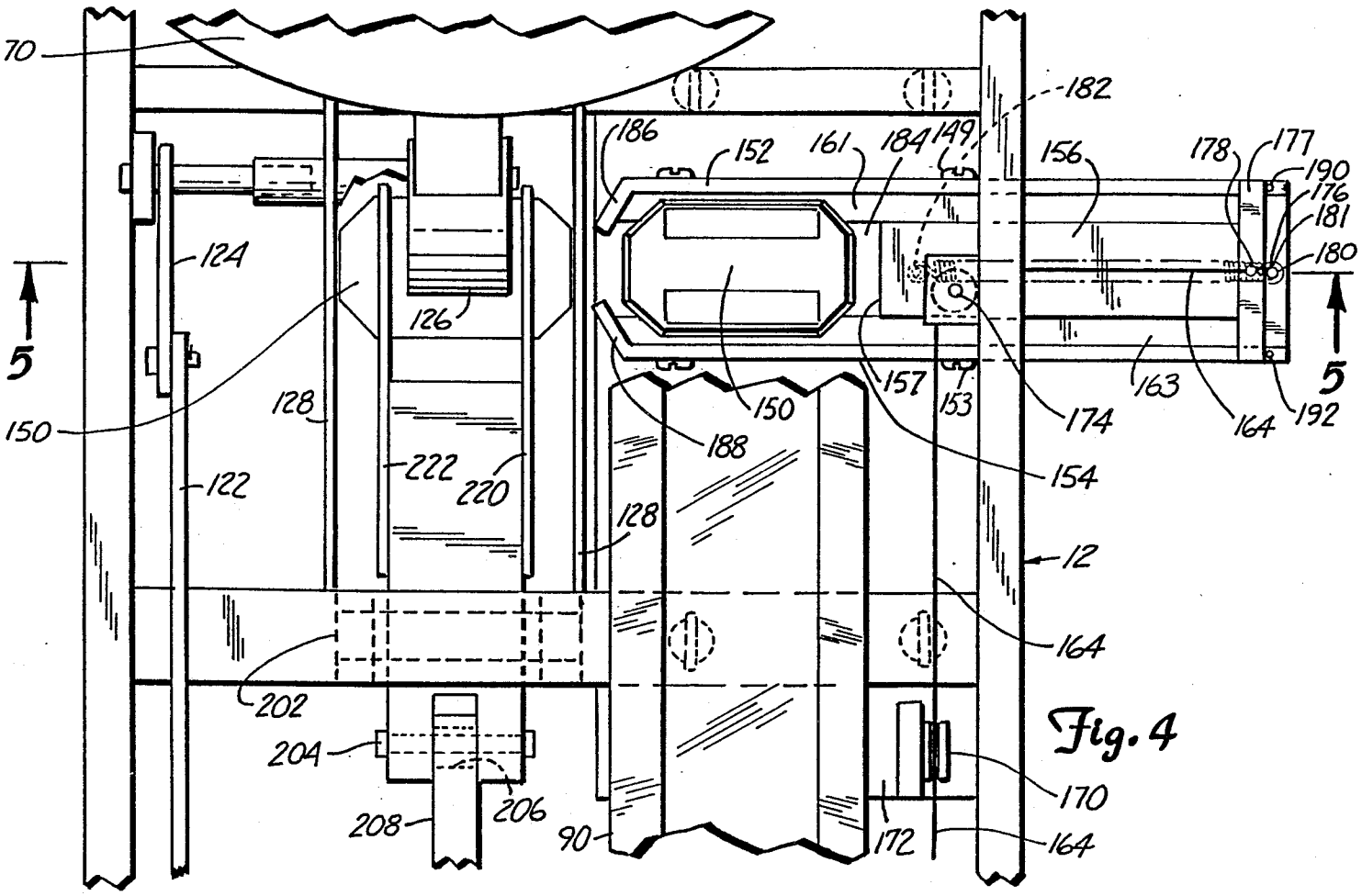
FIG. 4 is an enlarged plan view illustrating the dispensing assembly.

The flexible control cable 164 continues to be led forward to pulley 174 and then outwardly to the rightward end 176 of push bar 156, as best illustrated in FIG. 4. A spring 178 is attached to the outer end of slide frame 180 and to push bar 156 adjacent to the center at point 182. Spring 178 resiliently pulls push bar 156 back to a retracted position against a stop 181 of slide frame 180.

Figure 5:
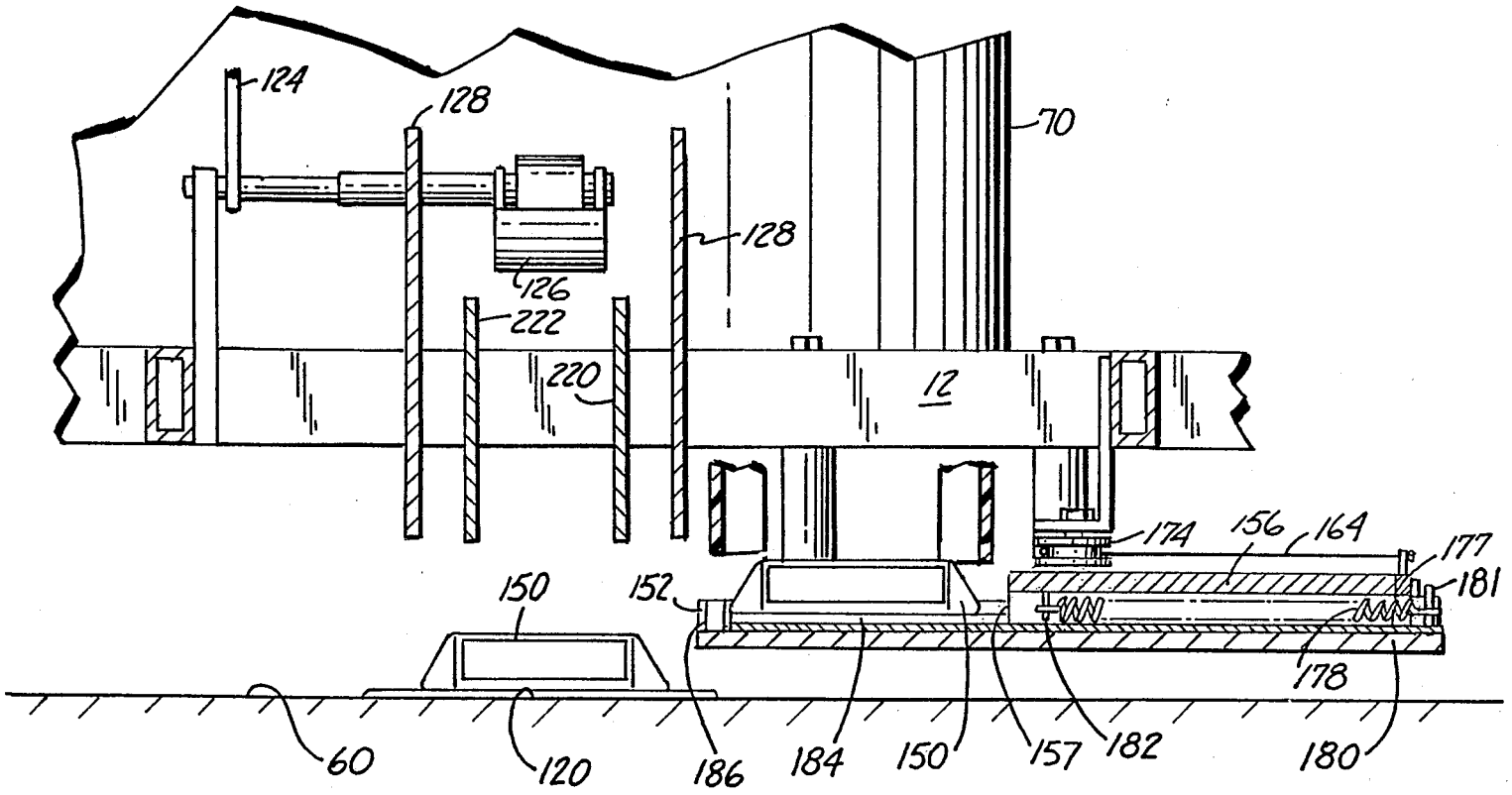
FIG. 5 is a partial sectional view at lines 5—5 of FIG. 4.
Figure 7A:
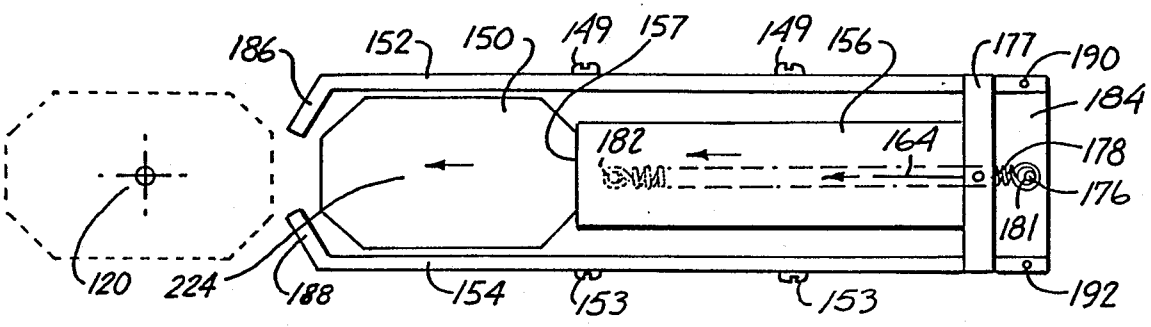
FIGS. 7A, B and C are partial sectional top views of the dispenser mechanism showing intermediate steps in dispensing using the mechanism shown in FIG. 4.

Pulling control handle 106 rearward pulls cable 164 rearward across pulleys 168, 170 and 174 and draws push bar 156 leftward against the resilient force of spring 178. The leftward motion of push bar 156 serves to sweep a raised pavement marker 150 from support deck 184 with left face 157, as shown in FIG. 5 and FIG. 7A.

Figure 7B:
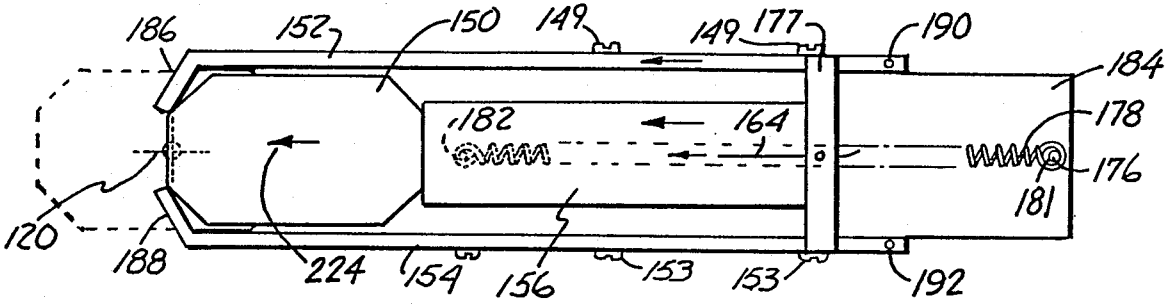
Figure 7C:
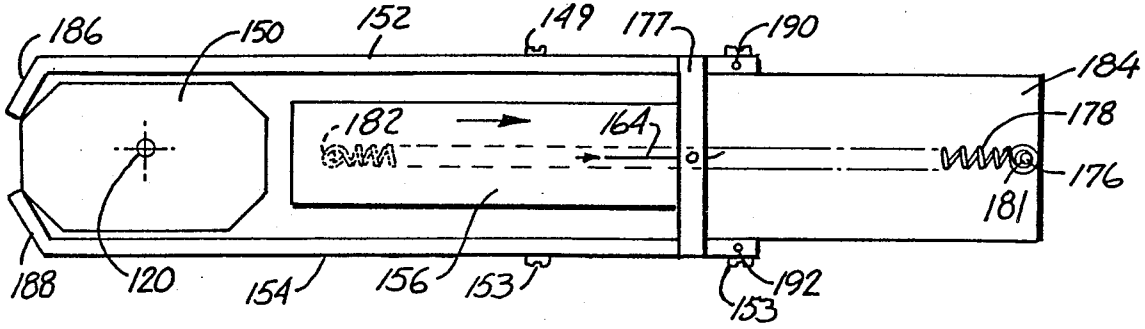

As left face 157 of push bar 156 sweeps raised pavement marker 150 (generally along its longitudinal axis 224) from support deck 184, the marker 150 engages a rearwardly turned ear 186 of forward slide bar 152 and a forwardly turned ear 188 of rearward slide bar 154. Once engage, ears 186 and 188 hold the raised pavement marker 150 against left face 157 in the position in which the marker 150 first engages the ears 186 and 188, as illustrated in FIG. 7B. As the push bar 156 continues leftward sweeping marker 150 from the support deck 184, slide bars 152 and 154 also travel leftward in the dispenser assembly 80. Such motion continues until the marker 150 is centered about position 120 of the roadway surface and above a deposit of adhesive. As illustrated in FIG. 7C, when the handle 106 is released, the push bar 156 begins to return to its rest position and marker 150 is freed from the hold of ears 186, 188 and left face 157 to drop upon position 120 of the roadway surface 60. Subsequent to dropping or releasing marker 150, projecting pins 190 and 192 of slide bars 152 and 154 respectively, a re contacted by bar 177 and slide bars 152 and 154 are returned to their resting position, as shown in FIG. 7A. Bar 177 can be attached to push bar 156 by known means such as screws, or it can be integral with the push bar.

Figure 6:
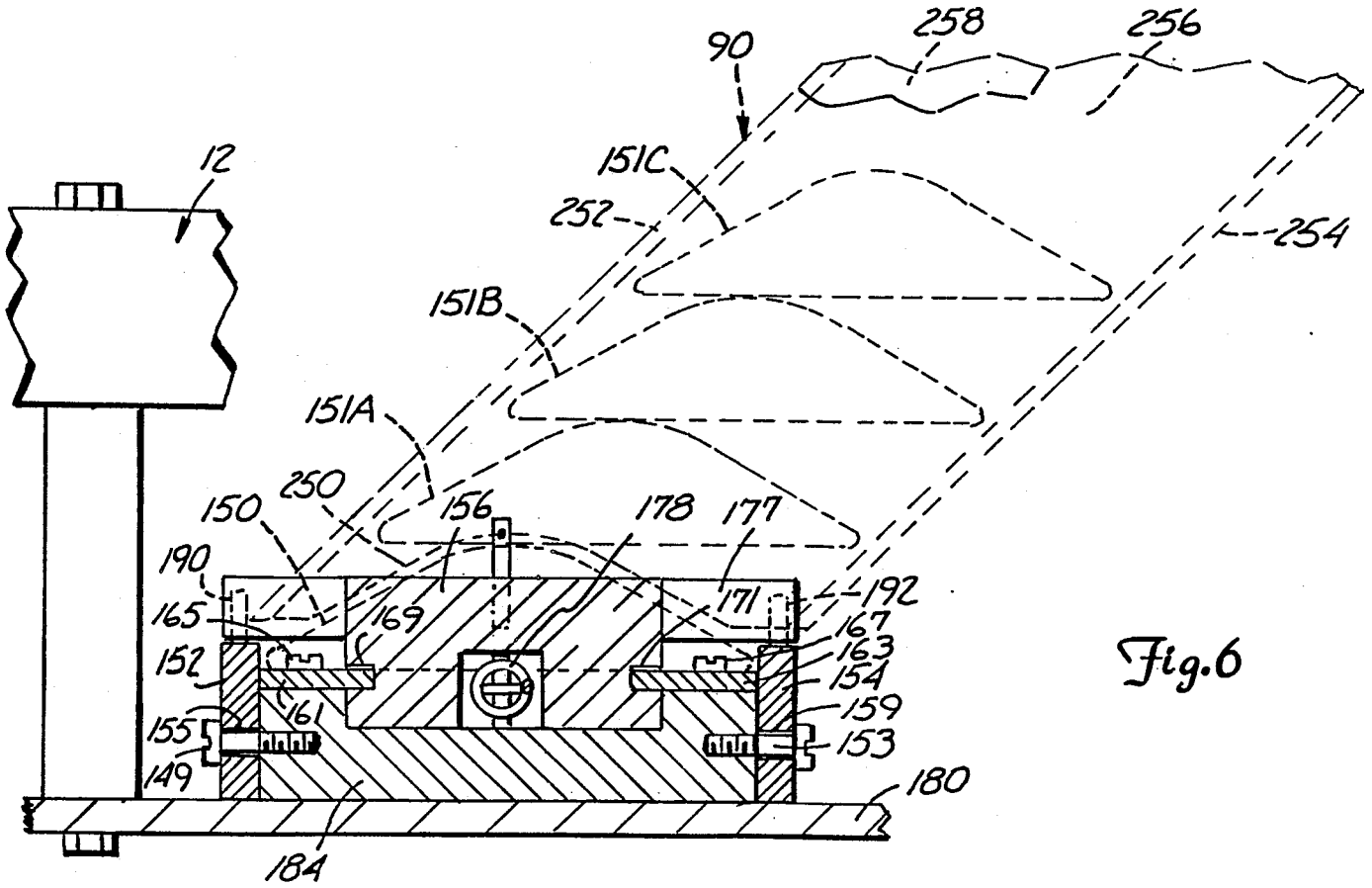
FIG. 6 is a partial sectional view at lines 6—6 of FIG. 1 with the magazine shown in broken lines.

The effective functioning of the dispensing assembly 80 requires that slide bars 152 and 154 frictionally engage the support deck 184. As illustrated in FIG. 6, slide bars 152 and 154 are secured to the support deck 184 by bolts 149 and 153 Which ride in slots 155 and 159, all respectively. By loosening or tightening the bolts 149 and 153, the frictional force between the slide bars 152 and 154 and the support deck 184 is decreased or increased. The amount of frictional force between the bars 152 and 154 and the support deck 184 will determine how tightly the marker 150 is held by the slide bars when the marker 150 is being transported, as illustrated in FIG. 7B, for centering about position 120. The greater the frictional force between the slide bars 152, 154 and the support deck 184, the more tightly the marker 150 is held between the slide bars 152 and 154 and the push bar 156.

Alternatively, shoulder screws can be used for bolts 149 and 153. The shoulders of such shoulder screws should rest against the surface of support deck 184. By using shoulder screws, one loses the ability to adjust frictional force on slide bars 152 and 154, but one gains an advantage, in that shoulder screws, properly installed, will not tend to come loose like ordinary machine bolts.

As push bar 156 returns to its resting position, the support deck 184 is cleared for and allows a subsequent marker 151A of FIG. 6 to drop from magazine 90 into place on support deck 184.

The travel of the push bar 156, as described with reference to FIGS. 7A, 7B and 7C, is directed by guide plates 161 and 163. The guide plates 161 and 163 are secured to the support deck 184 by bolts 165 and 167. Although single bolts 165, 167 are illustrated, it will be understood that a number of bolts are used to secure the guide plates 161 and 163 to the support deck 184. In addition, other means or securing the guide plates are within the scope of the present invention. The guide plates 161 and 163 engage slots 169 and 171 which are in opposing vertical side walls of the push bar 156.

MAGAZINE

Magazine 90, as shown in FIG. 6, has a lower mouth 250 positioned immediately over support deck 184. The magazine 90 has a first or forward wall 252 rising from the lower mouth 250 and inclined toward the rear 22 of the apparatus 10 at an angle of about 45° from vertical. Preferably, the forward wall 252 is segmented into spaced apart right and left portions 253 and 255 (see FIG. 1) which allow access to the interior of the magazine 90 for ease of loading and unloading of markers 151A–C. The magazine 90 also has a second or rearward wall 254 spaced apart from and parallel to forward wall 252. The walls 252 and 254 are connected by right side wall 256 and left side wall 258. Together the four walls 252, 254, 256, and 258 define a rectangular enclosure for storing and sequentially delivering markers 151A, 151B, 151C, and so forth to the support deck 184. The magazine 90 is a gravity feed magazine. In a preferred embodiment, the walls 252, 254, 256, and 258 are both smooth and possibly coated with a release agent capable of withstanding elevated temperatures to allow easy cleaning of dirt or stray adhesive.

The spacing between front and rear walls 252 and 254 is sufficient to allow a 3M type raised pavement marker 151 to be parallel to the support deck 184 but not to allow a marker 151 to be turned, twisted, or wedged sideways. A 3M type marker is about 76 mm in width. The spacing between the walls 252 and 254 accommodates that width when the bottom surfaces of markers 151A–C are parallel to the support deck 184 and pavement surface 60 but will prevent markers 151A–C from twisting such that the bottom surfaces are perpendicular to the front and rear walls 252 and 254. Marker 151B is supported by the rounded top of a lower marker 151A adjacent the front edge of the marker 151B and is also supported at the rear edge of marker 151B by rear wall 254. Thus, the marker 151 is supported forward of its center of gravity and rearward of its center of gravity and these supports define a plane generally parallel to the support deck 184. This arrangement supports the markers 151A, 151B, 151C, etc. such that the bottom of each marker is parallel to the roadway surface 60 and the support deck 184 and prevents twisting or jamming of markers 151A, 151B, 151C, etc. during delivery to the support deck 184. The magazine 90 can be altered from a preferred incline of 45° from vertical to steeper angles of from about 15° from vertical (which requires a slight increase in front and rear wall spacing) or lower angles from about 75° from vertical (which requires a slight narrowing of wall to wall spacing).

ALIGNMENT ASSEMBLY

Figure 8:
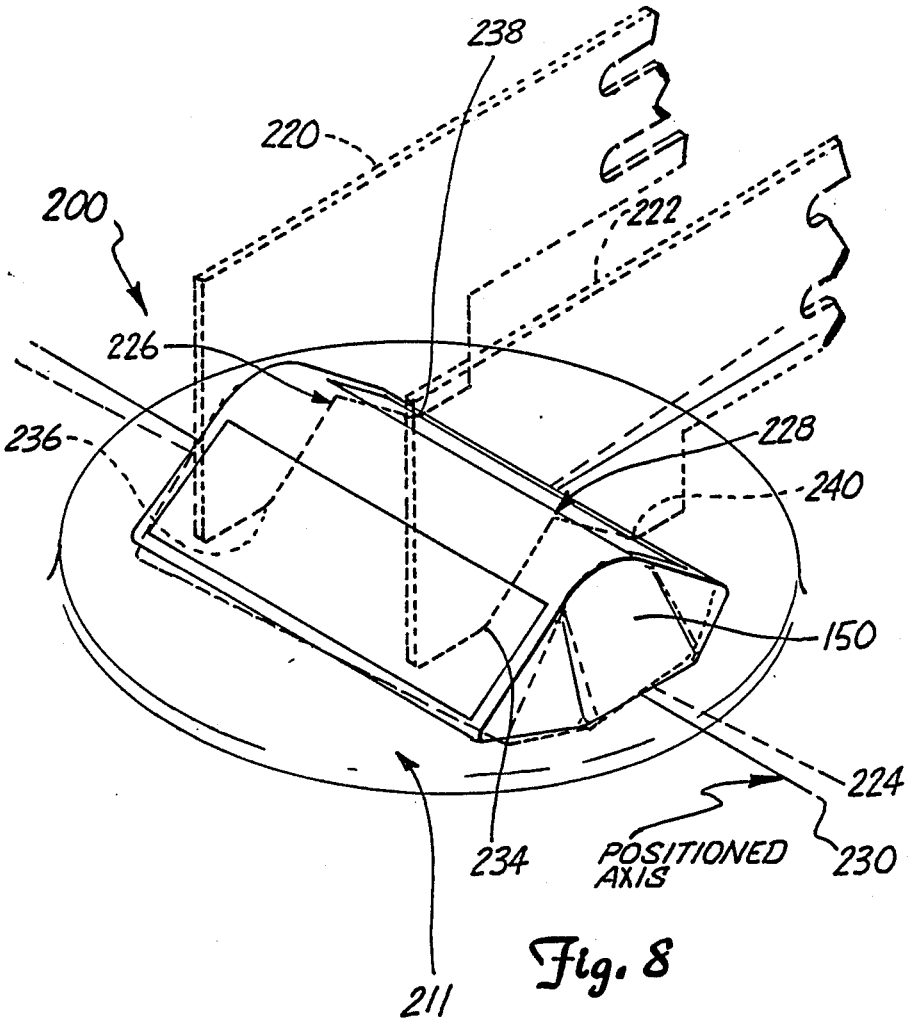
FIG. 8 is a perspective view of a raised pavement marker in an aligned oriented position, with the initial position and a portion of the orientation assembly shown in dotted outline.

Subsequent to dispensing of a marker 150 upon a deposit of adhesive at position 120 on a roadway surface 60, the marker 150 should be properly aligned for effective recognition by vehicular traffic. The apparatus 10 includes an alignment assembly 100 for insuring proper alignment of the raised pavement marker 150. The alignment assembly 100 includes an alignment mechanism 200 of FIG. 3. The alignment mechanism is pivoted at pivot point 202 and driven at pin 204 by forward opening slot 206 on the forward end of a bar 208. Bar 208 is rigidly connected, at its opposite or rearward end, to foot pedal 108. Bar 208 is pivotably carried by pin 210, such that when foot pedal 108 is depressed, slot 206 is elevated, slidably lifting pin 204, thereby forcing alignment mechanism 200 downward to contact the top of a dispensed raised pavement marker 150 in liquid adhesive deposit 211, as shown in FIG. 8.

Alignment mechanism 200 includes a pair of spaced-apart arms 220 and 222. Dispensed raised pavement marker 150 has a longitudinal axis 224 which may be slightly skewed relative to a desired orientation with respect to vehicular traffic. The two spaced-apart arms 220 and 222 each include V-notch surfaces 226 and 228, respectively, which can accommodate and center a portion of a raised pavement marker 150. Together, the V-notch surfaces 226 and 228 serve to align the raised pavement marker 150 to a correct and desired positioned axis 230. This is accomplished by a sliding action of a radius surface 234, 236, 238 and 240, respectively, at the forward and rearward edge of the notches 226 and 228. Specifically, two of the four radius portions 234, 236, 238 and 240 slide against the sloped sides of the raised pavement marker 150 such that the orientation and positioning becomes correctly aligned.

Additionally, the downward motion of the alignment mechanism 200 serves to slightly depress the raised pavement marker 150 into the adhesive deposit 211, in turn encouraging adhesive contact and particularly forcing small amounts of adhesive into cavities opening at the bottom of the raised pavement marker 150. Hot melt adhesive deposits "set" or harden within about one minute as typically discharged onto a roadway surface 60. Thus, the convenient location of the foot pedal 108 allows alignment of marker 150 to a desired orientation and good adhesive contact to occur within the time constraints of the hot melt adhesive deposit 211. Good adhesive contact is necessary for effective adhesion of the marker 150 to the roadway surface 60 and maintenance of the proper aligned orientation 230.

In an alternative embodiment envisioned by the inventors, a push bar and slide bars run fore and aft (i.e. going toward the front and rear of the applicator apparatus), rather than sideways, to sweep and carry a raised pavement marker, perpendicular to its longitudinal axis, off the support deck for release and dispensing onto an adhesive deposit on a roadway surface. The alternative embodiment allows a narrower apparatus which would interfere less with traffic flow along the edge of a roadway. Additionally, a fore and aft sliding embodiment would require a shorter reciprocating travel of the push bar and the slide bar.

In another alternative embodiment, the valve for discharging liquid adhesive, raised pavement marker dispenser, and alignment mechanism may be mounted upon a modular frame such that each is directed to a common desired point on a roadway surface. The modular frame is in turn mounted upon a carriage riding a short track mounted transverse to normal rolling direction of the inventive apparatus. The alignment mechanism is oriented to properly align a raised pavement marker such that the longitudinal axis is perpendicular to the direction of traffic flow. With the motion of the apparatus arrested, the carriage may be moved perpendicular to traffic flow direction to properly position an applied raised pavement marker a desired distance from an edge of the roadway. In this embodiment, the adhesive reservoir may be mounted on the modular frame or alternatively mounted upon a truck and liquid adhesive supplied to the valve by flexible tubing. Additionally, the force to move the various controls may be supplied by hydraulic or air pressure means upon a truck. Such an arrangement facilitates remote control of the mechanism.

In conclusion, the apparatus of the present invention enables efficient application of a raised pavement marker, with a rounded top, onto a pavement. The apparatus carries a reservoir of adhesive and a brake mechanism. With the apparatus aligned and the brake set to arrest any motion, a deposit of adhesive can be discharged on top of the roadway, and the orientation of the marker aligned for effective observation of retroreflective properties by traffic. Finally, the brake may be released and the apparatus moved to a subsequent position for the next marker application.

Although the present invention has been described with reference to preferred embodiments, workers skilled in the art will recognize that changes may be made in form and detail without departing from the spirit and scope of the invention.

What is claimed is:

1. An apparatus for oriented application of a raised pavement marker to a roadway surface comprising:

a reservoir of liquid adhesive;

means for discharging a portion of liquid adhesive on the roadway surface;

means for dispensing a raised pavement marker on top of the deposit of liquid adhesive which dispensing means comprises:

a support deck having an upper surface adapted for receiving a pavement marker and on which the bottom of the pavement marker rests;

a reciprocating push bar for sweeping a pavement marker from the support deck;

a guide means slidably connecting the push bar to the support deck and allowing reciprocal movement of the push bar relative to the support deck, wherein the reciprocal movement consists of a sweeping stroke and a return stroke; and a holding means which holds said pavement marker during the sweeping stroke and releases it on the return stroke and which reciprocates in conjunction with the push bar and in the same direction.

2. The apparatus of claim 1 wherein the raised pavement marker has a substantially planar lower surface adapted for contact with the adhesive deposit and a nonplanar opposite surface which avoids simple vertical stacking of a plurality of said markers and wherein the apparatus further comprises a magazine for storing and sequentially delivering a plurality of raised pavement markers to the means for dispensing with the lower surface of the dispensed marker substantially parallel to the roadway surface.

3. The apparatus of claim 3 wherein the magazine includes a first inclined wall and stores each subsequent raised pavement marker of the plurality substantially parallel to the roadway surface, supported at a first edge of the bottom surface by the inclined wall and at a second spaced apart portion of the bottom surface by an upper portion of a preceding and underlying raised pavement marker in the magazine.

4. The apparatus of claim 3 wherein the magazine further includes a second inclined wall parallel to the first inclined wall and adapted for sliding contact with a second edge of the bottom surface opposite the first edge.

5. The apparatus of claim 4 wherein the magazine further includes a pair of walls perpendicular to the roadway surface connecting the first and second inclined walls to define an enclosed magazine and serving to limit lateral shifting of raised pavement markers in the magazine.

6. The apparatus of claim 3 wherein the pavement marker has sloped sides and a rounded top and the first inclined wall of the magazine is inclined at an angle of from about 15° to about 75° from vertical.

7. The apparatus of claim 4 wherein the second wall is comprised of two-spaced apart portions allowing access to the interior of the magazine.

8. The apparatus of claim 1 which further comprises an aligning means comprising two spaced-apart correction arms adapted for positioning the raised pavement marker.

9. The apparatus of claim 1 wherein the raised pavement markers have a longitudinal axis and the reciprocating push bar is oriented so that the reciprocating motion is fore and aft of the apparatus and perpendicular to the longitudinal axis of the raised pavement marker.

10. The apparatus of claim 1 wherein the holding means comprises a pair of sliding bars which, together with the push bar, frictionally engage the raised pavement marker.

11. An apparatus for application of a raised pavement marker to a surface comprising:

a reservoir for liquid adhesive;

means for discharging a portion of liquid adhesive on the surface;

means for dispensing a raised pavement marker onto the deposit of liquid adhesive; and means for aligning said raised pavement marker comprising first and second spaced-apart correction arms adapted for positioning the raised pavement marker.

12. The apparatus of claim 11 wherein the correction arms each have V-notched surfaces with curved sides for alternatively contacting a front or rear sloped side of a raised pavement marker.

13. The apparatus of claim 12 wherein the correction arm curved sides make a sliding contact with a sloped side of any misoriented raised pavement marker moving the raised pavement marker into a desired position.

14. The apparatus of claim 1 wherein the liquid adhesive is a two-part catalyst and epoxy mixture and the means for discharging includes a means for mixing the epoxy and catalyst.

15. The apparatus of claim 1 wherein the liquid adhesive is a hot-melt bitumen.

16. A dispenser for raised pavement markers comprising:

a support deck having an upper surface adapted for receiving a raised pavement marker, a push bar adapted for sweeping the upper surface of the support deck;

guide means slidably connecting the push bar to the support deck and allowing reciprocal movement of the push bar relative to the support deck, wherein the reciprocal movement consists of: a sweeping stroke; and a return stroke;

means slidably mounted to the support deck, for holding a raised pavement marker against the push bar during a sweeping stroke and releasing the raised pavement marker on a return stroke.

17. The dispenser of claim 16 and further comprising:

a magazine adapted for storage and delivery of a plurality of raised pavement markers to the upper surface of the support deck.

* * * * *